US006331222B1

(12) United States Patent
Hotkowski et al.

(10) Patent No.: US 6,331,222 B1
(45) Date of Patent: Dec. 18, 2001

(54) SPLICER FOR JOINING THIN SHEETS

(75) Inventors: Peter D. Hotkowski, Chester; Frank A. Todaro, Old Saybrook; Daniel J. Williams, Westbrook; Peter C. Burton, East Haddam; Brian C. Richardson, Bozrah, all of CT (US)

(73) Assignee: Asterisk, Inc., Old Saybrook, CT (US)

( * ) Notice: Subject to any disclaimer, the term of this patent is extended or adjusted under 35 U.S.C. 154(b) by 0 days.

(21) Appl. No.: 09/187,376

(22) Filed: Nov. 6, 1998

Related U.S. Application Data

(60) Provisional application No. 60/063,986, filed on Nov. 6, 1997.

(51) Int. Cl.[7] ..... B31F 5/06; B65H 19/18; B65H 21/00

(52) U.S. Cl. ..... 156/157; 156/304.3; 156/502; 156/505; 156/506; 242/556.1

(58) Field of Search ..... 156/505, 506, 156/502, 157, 304.3; 242/556.1

(56) References Cited

U.S. PATENT DOCUMENTS 5,779,851 * 7/1998 Ifkovits et al. ..... 156/505

OTHER PUBLICATIONS

The Laserfeed Company "How To Use The Laserfeed Splice Rite® ", unknown date, Instruction Sheet, One Page.

Laserlink Corporation "LC4000 Splice Cart Unit (SCU)", unknown date, Catalog Sheet, One Page.

Energy Saving Products Co. "The Laserfeed Company Document Processing Solutions", unknown date, Catalog Sheet, One page.

* cited by examiner

*Primary Examiner*—Adrienne C. Johnstone
(74) *Attorney, Agent, or Firm*—C. G. Nessler

(57) ABSTRACT

A splicer for joining with tape the abutted ends of two sheets, such as the headers and footers of stacks of fanfold paper to be printed upon, is comprised of a clamp assembly and a tape dispenser. The clamp assembly captures the ends of the sheets between the resilient surfaces of a base and a movable top comprised of two spaced apart bars. Pins in the base help align perforated paper for joining. The dispenser runs along the slot between the two bars. It dispenses, presses down, and cuts the tape as it is laid along the butt-line between the ends of the sheets. An optional reversing bar causes the two sheets to travel along different shape paths to the splicer, thus enabling application of tape to the opposing sides of the sheets.

11 Claims, 6 Drawing Sheets

SPLICER FOR JOINING THIN SHEETS

This application claims benefit of provisional patent application Ser. No. 60/063,986, filed Nov. 06, 1997.

TECHNICAL FIELD

The present invention relates to devices for joining together thin sheets of material, such as sheets of paper, particularly in connection with operations in the printing field.

BACKGROUND

In feeding paper and other sheet materials to printers and other kinds of finishing machines, it is often a desire that the feeding of sheet material be continuous. Thus, when the sheet material is supplied in batches, a first batch must be connected to the second batch upstream of the processing machine. While such a need is present when handling rolls of sheet material, it is particularly present when fanfold sheet and the like are being fed. Fanfold sheet is usually supplied in relatively small cartons or stacks which can be readily handled by an individual worker. Thus, for continuous operation, each small quantity of fanfold sheet must be joined to the other. More specifically, the tail end of the pages, or the "footer", of a stack being used up must be joined readily and reliably to the first pages, or header, of the next stack to be processed.

Typically, fanfold paper will have perforated side edges suited for engagement by sprockets on the printing machine being fed. Thus, it is highly desirable that the hole-to-hole spacing across any splice be maintained. Splice joints must be made quickly and easily, and be strong and consistent. The splicing tape ought not run into the region where the sprocket-perforations are. Typically, the splice tape will have fine perforations running along its centerline, so that when the tape is used to make a splice, the fanfold sheet will not have a discrepancy insofar as fanfolding and segmentation is concerned. Thus, it is important that the perforation is carefully aligned with the joint between butt joined sheets. In the most basic way of joining sheets, an operator manually, and without mechanical guide, runs a piece of tape across the joint between the header and footer while they are hand-held in proximity. Different fixtures have been employed, and of course there are a variety of commercial holders for applying tape to the surfaces of objects.

Generally, the prior art splicing devices have either of two general types of inadequacies. Either they are cumbersome and slow to use, or they do not place the tape accurately. Consequently, there is a continuing quest for a splicer which has good performance, ease of use, reliability, and reasonable cost. The present invention is concerned primarily with satisfying such needs for joining fanfold paper sheets, in the context that any such improvement will have other applications.

SUMMARY

An object of the invention is to provide a way for making splice joints reliably and efficiently between the ends of sheets, particularly between headers and footers of stacks of fanfold paper. Another object of the invention is to provide in a splicer a tape dispenser which ensures that tape laid on a splice joint is well adhered across the whole length of the joint.

In accordance with the invention, a splicer for joining the ends of sheets is comprised of a clamp assembly and a dispenser. The clamp assembly is comprised of a base, and a top which is adapted to move toward and away from the base, preferably by pivoting. The top is comprised of two spaced apart bars running along the length of the base, thereby defining a lengthwise slot. The underside of each bar is surfaced with a first resilient material. The top surface of the base has a layer of second resilient material. When the clamp assembly top and base are mated, the two layers of first resilient material mate with the layer of second resilient material. Thus, when the ends of the sheets to be spliced are butted together within the assembly, so the butt line lies centrally along the length of the slot in the top, the sheet ends are frictionally held in place. A dispenser for applying tape to the joint is slidable lengthwise and vertically within the slot of the top. When the dispenser is moved along the slot, the dispenser lays down tape across the joint butt-line and automatically cuts it at the end. Thereafter, the clamp assembly may be opened and the spliced sheets removed. In different embodiments, the top may pivot or translate relative to the base, to open and close the clamp assembly.

Preferably, when perforated sheet is being spliced, there are sets of blocks having pin arrays on each side of the base. Each set is comprised of a rear block near the rear end of the base; and, a front block at the front end of the base. The rear block is preferably adjustably positioned along the length of the base, according to the width of paper being joined. The front block has an internal spring mechanism for biasing of the pin array away from the rear block. Thus, when the operator places the end of a perforated sheet on the base, the operator manually biases the front block toward the rear block, releasing it when the perforations of the sheet are engaged with the opposing block pin arrays, to thereby tension the sheet prior to closing the clamp.

As the tape dispenser is guided along the joint between the sheets, the tape is fed down the front part of the dispenser and laid on the joint by adhesive engagement of the tape with the sheets. The tip or lowermost part of the dispenser presses the tape onto the sheet surface as the dispenser moves. Preferably, the tape dispenser is pivotally mounted with a somewhat loose fit on the pivotable arm of a carriage assembly which is moved manually lengthwise along the top. That fit and the fit between the lower end of the dispenser and the slot in the top enables the dispenser to rock slightly in the plane transverse to the dispenser travel path. Thus, the lower end of the dispenser will maintain contact with the sheets, as the dispenser lower end runs over small variations and unevenness, ensuring good and continuous adherence of the tape. A wiper, supported off the carriage, rubs along the tape just behind the point of adhering. It's principal function is to ensure that the first laid, or beginning, portion of the tape is adhered. Proximate the end of the dispenser travel path along the joint, the dispenser is caused to rotate and lift, preferably by means of interaction of the dispenser and carriage with two cams on the base. A first cam engages a pin on the dispenser, rotating it slightly in the longitudinal vertical plane of the top. A second cam engages the carriage arm on which the dispenser is mounted, lifting it slightly. The rotating and lifting motion cause a knife located rearward of the dispenser bottommost tip to contact and cut the tape, while avoiding contact with the resilient strip on the base surface. The cam-induced motions also cause the tip of the dispenser to lift and the trailing edge of the lower end of the dispenser to contact the tape, so that the very last part of the tape which is laid down will be pressed firmly onto the sheet surface.

The splicer preferably has a vertical post extending downward to the machine at which splices are to be made, such as a stacker-feeder; and the post and related structures provide the splicer with a combination of vertical motion, two horizontal motions, and rotary motion about the post. Alternately, the splicer it is mounted from a dolly base or on a bench. The splicer optionally includes a reversing bar which is mounted at an elevation above the clamp, so that when a header or footer is run to the splicer it may be made to follow an S-shape curve path, while the other header/footer is made to follow a U-shape path. Thus the sides of sheet which are presented to the tape dispenser or other joining means are reversed, and the tape is placed on the underside of the sheet joint.

The foregoing and other objects, features and advantages of the invention will become more apparent from the following description of preferred embodiments and accompanying drawings.

DESCRIPTION

Figure 1:
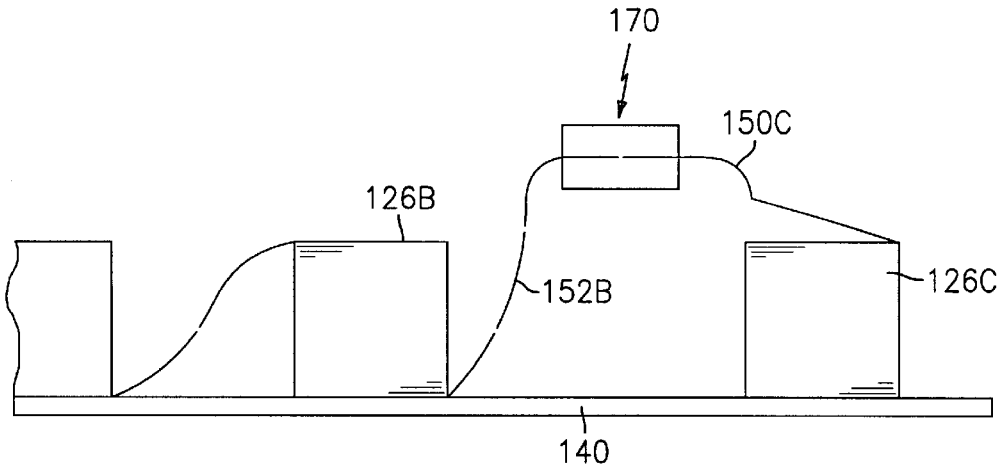
FIG. 1 shows schematically how the header and footer of stacks are spliced.
Figure 12:
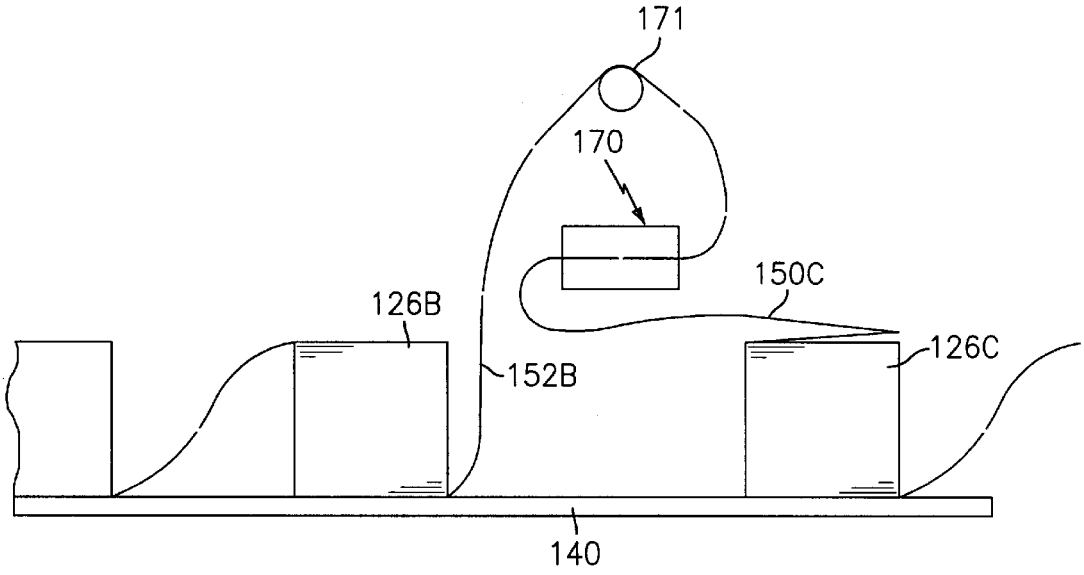
FIG. 12 is a view like FIG. 1, showing the side of the sheet presented for splicing is reversed.
Figure 11:
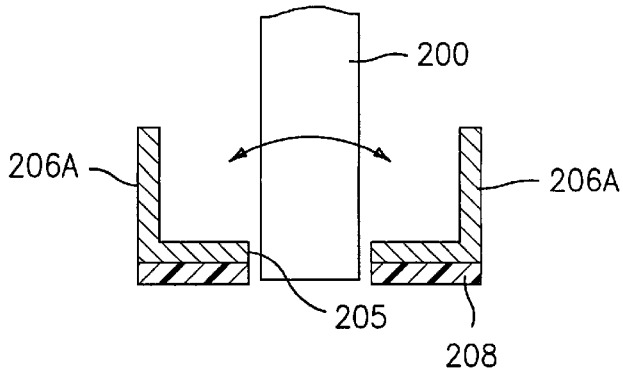
FIG. 11 is an end view like FIG. 4, showing an alternate configuration top.
Figure 2:
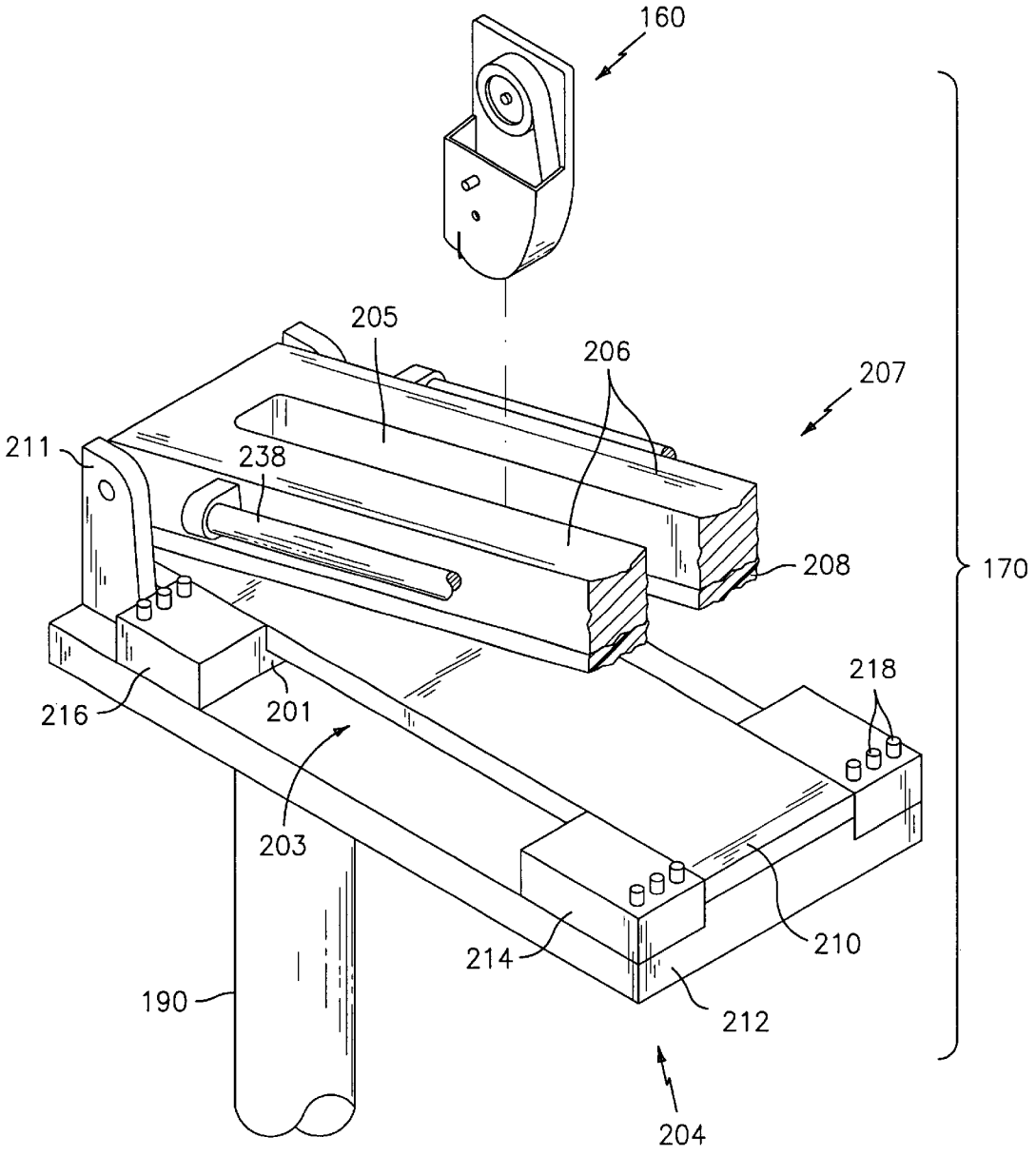
FIG. 2 is a perspective view of the base assembly and dispenser of a splicer mounted on a post, ready to receive sheets.
Figure 3:
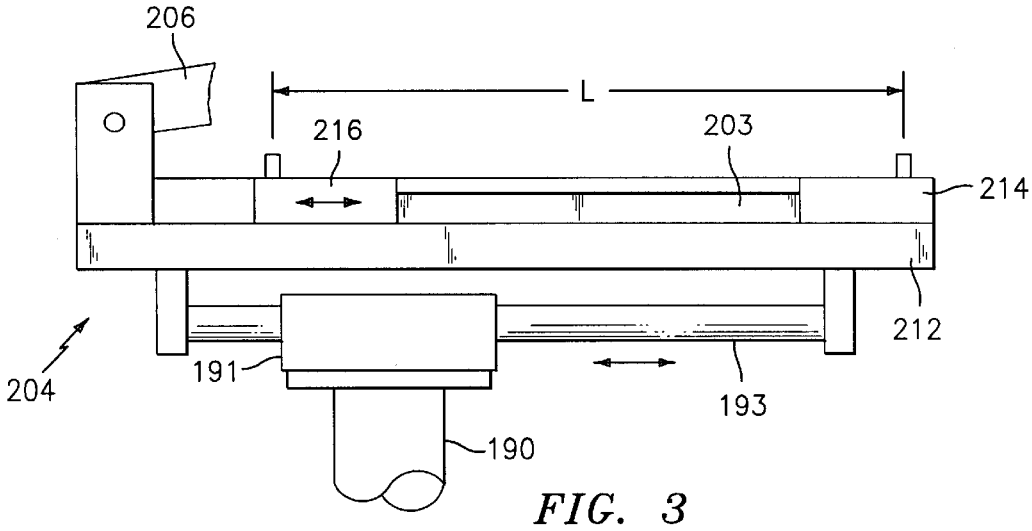
FIG. 3 is a side elevation view of portions of the device shown in FIG. 2.
Figure 4:
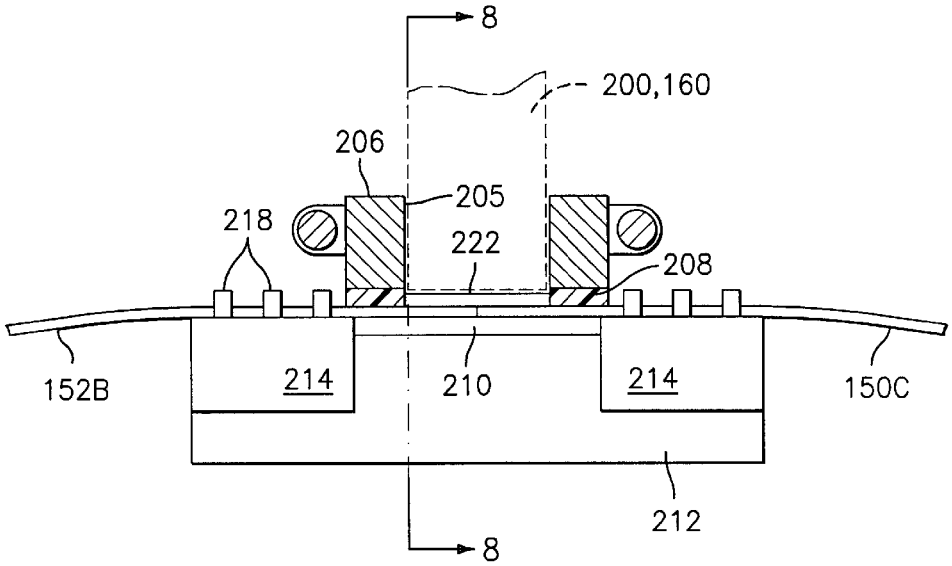
FIG. 4 is an partial cross section elevation view from the outer, or front, end of the splicer shown in FIG. 2, when the clamp assembly is in the closed position, just after sheets have been joined together by a piece of tape.
Figure 5:
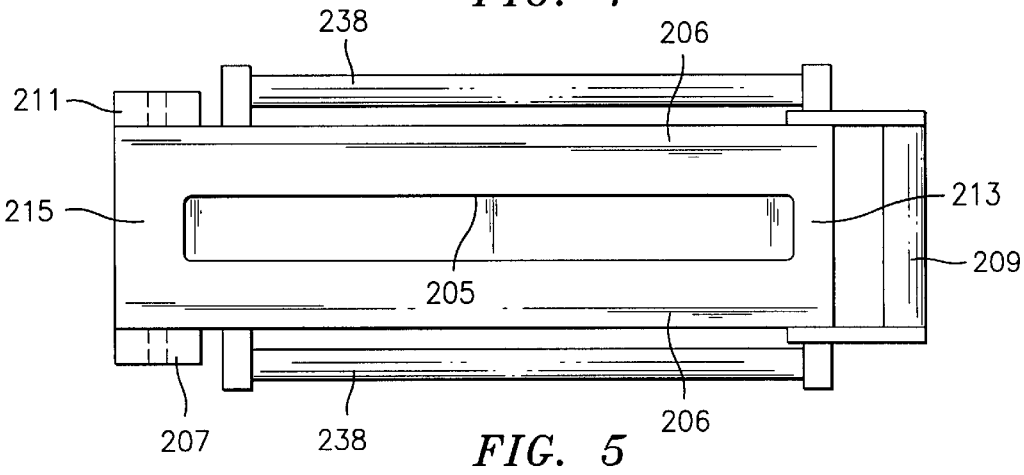
FIG. 5 is a top view of the top part of the device shown in FIG. 2.
Figure 6:
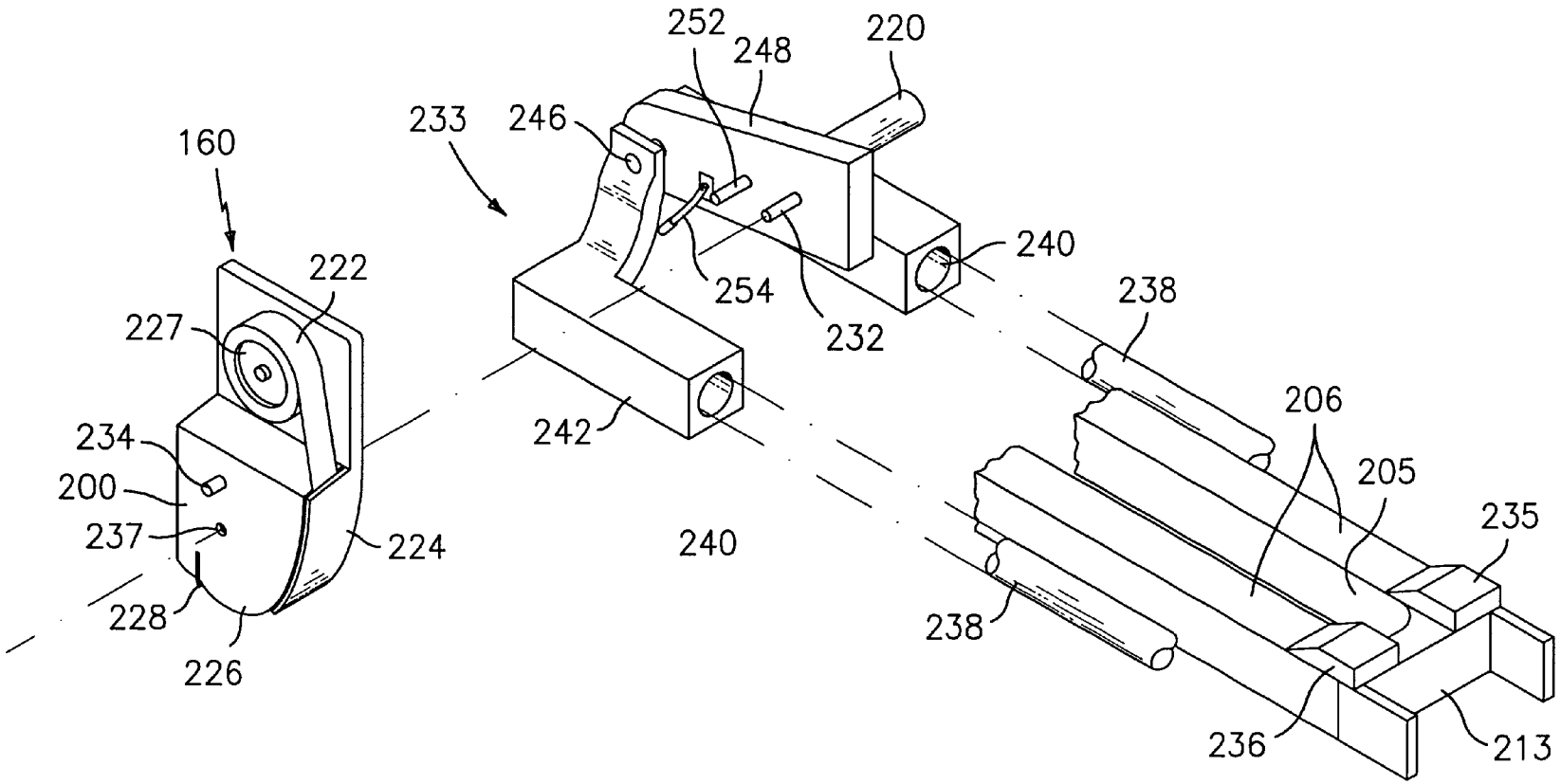
FIG. 6 is an exploded view of a dispenser and a carriage, showing how the dispenser-carrying carriage rides along rods on either side of the base of the splicer.
Figure 7:
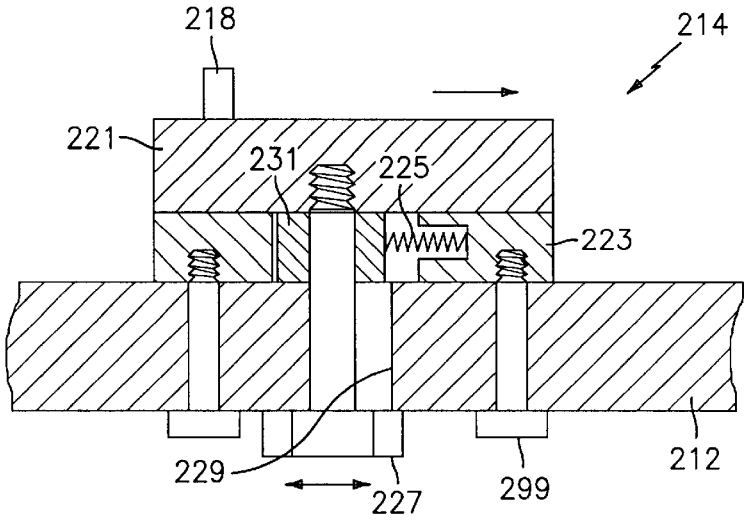
FIG. 7 is an elevation cross section view of a pin block which mounts on the base of the splicer.
Figure 13:
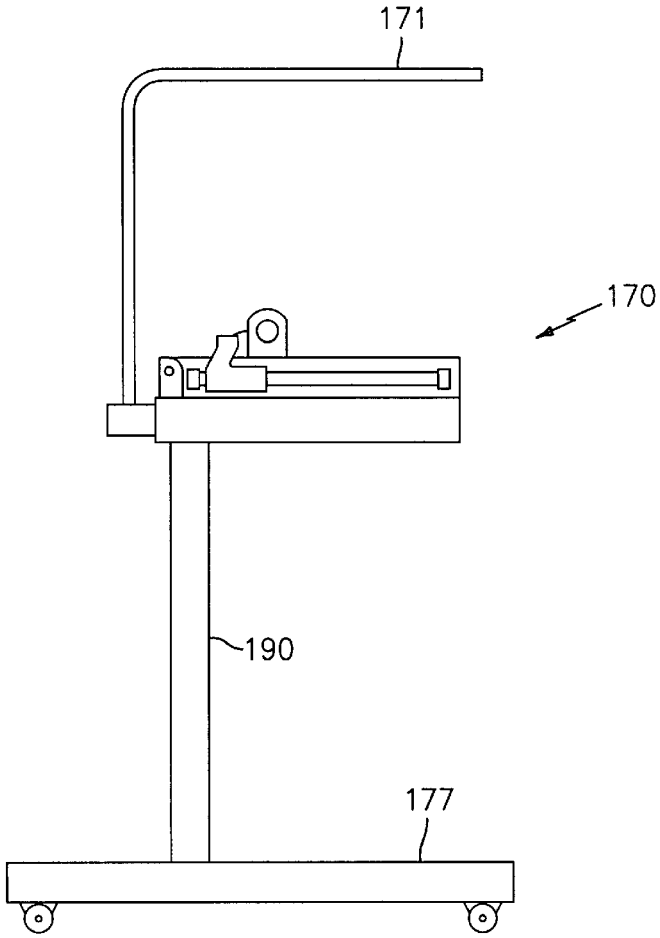
FIG. 13 is an elevation view of a splicer on a column which extends from a dolly base, with a bar above the splicer, to carry out the method illustrated by FIG. 12.
Figure 9:
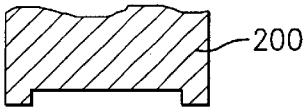
FIG. 9 shows a cross section of the tape guide at front of the lower end of the tape dispenser.
Figure 10:
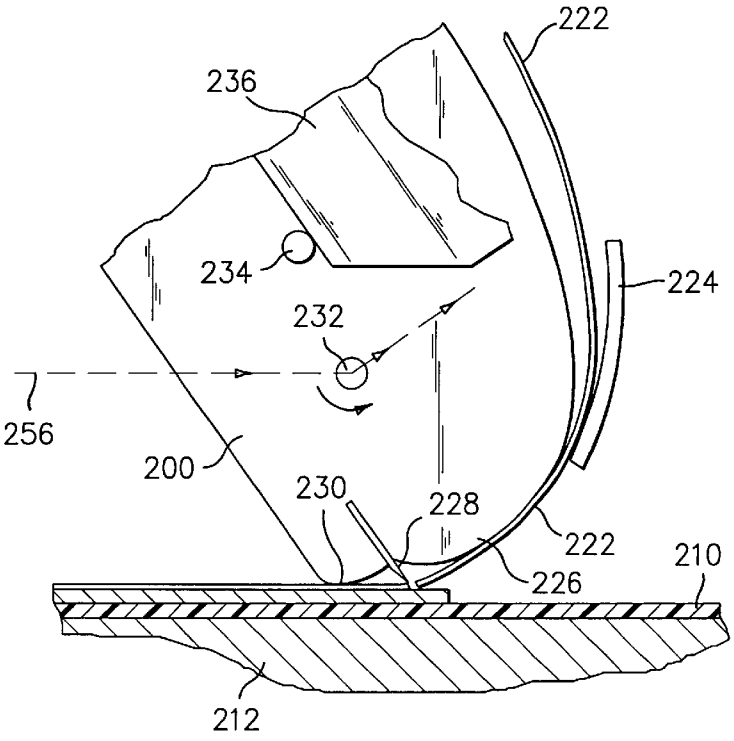
FIG. 10 is a view like FIG. 8, illustrating the motion of the tape dispenser at the end of the dispenser travel path along the top of the splicer.
Figure 8:
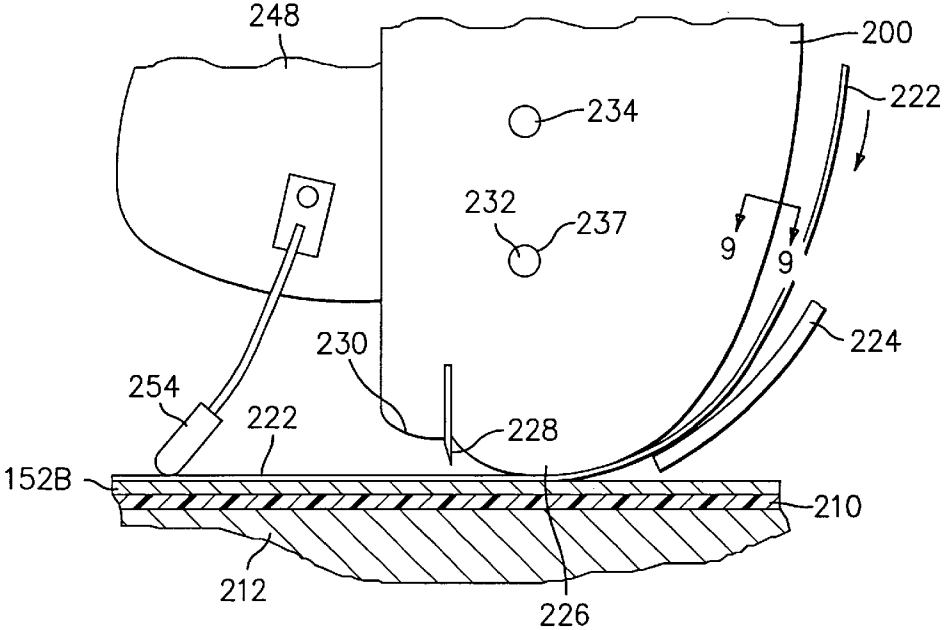
FIG. 8 is an elevation view of the lower portion of a tape dispenser, showing how it dispenses tape.

The invention is principally described in terms of joining together the ends of paper sheets, where the pages are the ends of fanfold sheets of the type familiarly used in the printing industry. The invention will be understood to be applicable to joining together of pieces of other types of paper, and to joining together of thin sheets of various other materials. Fanfold sheet is also commonly referred to as fanfold paper, fanfold pages and fanfold forms. All the foregoing are terms of art, referring to a continuous piece of sheet material (which commonly comprises cellulose pulp but may comprise some other material such as plastic, etc.), where the continuous sheet has periodic creases or serrations, so that when received at a point, the sheet folds in a zig-zag fashion to form a stack. The individual segments are referred to as pages herein. Fanfold paper commonly has spaced apart holes or perforations along the opposing side edges of the pages of the sheet, to engage sprockets on the machines handling or processing such kind of paper, for positive feeding. As was mentioned in the Background, the last pages from a first stack, or folded sheet, are called a footer; and, the first pages from a second stack, or folded sheet, are called a header, particularly when they are intended to be joined to each other, as is the case in this Description. Reference may be had to related U.S. Pat. No. 6,142,288, entitled "Fanfold Sheet Feeder Having Stack Postioner", herewith, and common assignee. The Description thereof is hereby incorporated by reference. The related application describes how separate stacks of fanfold sheets are successively moved along a conveyor belt to a discharge point, and how the sheets of stacks are joined one-to-the-other for continuous output of fanfold sheet.

FIG. I illustrates schematically how a splicer 170 is used to connect the top pages or header 150C of a second stack 126C with the bottom pages or footer 152B of first stack 126B, which was previously deposited on a surface such as a conveyor belt 140. FIG. II is a perspective view of the splicer components. Reference ought also be had to the side elevation view of FIG. III the end view of FIG. IV, the top view of FIG. V, and the exploded view of FIG. VI. FIG. IV shows the header and footer of two sheets clamped in the splicer just after a piece of tape 222 has been laid across the joint.

As illustrated by FIG. II, the splicer 170 is comprised of the tape dispenser 160 (shown with limited detail) and a clamp assembly 204. Referring to the several Figures, the clamp assembly is comprised of a base 212, having the shape of an inverted tee, and a pivotable top 207. The top is comprised of two spaced apart and parallel bars 206. The bars are joined together at the pivot end and outer end by connecting members 215 and 213 respectively. For illustration purposes, the outer connecting member 213 and pull-down handle 209 of the top are only shown in FIG. V. The top is pivotably mounted from the base by means of pin 209 at the uprights 211 which extend from opposing sides of the rear end of the base 212. When a splice is made, the top is pivotably lowered onto the base as illustrated by the end view of FIG. IV.

A strip 210 of high frictional engagement rubber, for example, a 0.030 inch thick strip of neoprene rubber having a Shore A Durometer of about 70, runs along the length of the center of the top surface of the base. A strip 208 of comparatively thick (e.g. 3/16 inch) foam elastomer, for example, polyvinylchloride foam rubber which has 25% deflection at 4 psi load, runs along the bottom surface of each bar 206. The resilient strips have widths and relative locations such that, when the top is lowered onto the base 205, they provide deflectable surfaces for accommodating irregularities of fit between the top and base, and surfaces for frictionally engaging the sheets, such as the header and footer of sheets 152B, 150C, very close to the point where they butt and are to be joined. See FIG. IV.

The sheets are initially held in position, before rotational closing of the top, by means of pins 218 at four locations. Two rear pin blocks 216, each having an array of pins 218, are mounted on opposing sides of the rear end of the base 212. They are connected to each other by a mostly hidden bar 201 running through horizontal slot 203 of the base. See FIG. II and III. Two somewhat different construction front blocks 214, also having pin arrays 218, are attached to the base near the front end of the base. The pin sets are located at the outermost ends of the blocks, so the top surface of the block which runs lengthwise toward the center of the splicer provides support for the sheet which runs between the pins.

The front blocks 214 have essentially fixed positions. The rear blocks 216 are slidable lengthwise along the base length. They may be secured in any given lengthwise position by intentional heavy frictional resistance (about ten pounds breakaway force) within the slot 203 of their connecting bar, or by locking screws. The rear blocks 216 are set at a selected position along the length of the base, according to the width of the paper being handled. More specifically, the rear blocks 216 are set so that the distance L between the rear block pin sets and the front block pin sets is slightly greater than the distance between the rows of perforations on opposing sides of the sheet. See FIG. III.

With reference to the partial cutaway side view of FIG. VII, each front block 214 is comprised of a sub-block 223, which is fastened to the flange of base 212 by screws 299, and a cap 221 which is slidable on the sub-block. The cap is held onto the sub-block by main screw 227 which runs through, and moves freely laterally within, a slot 229 in the flange of base 221. Spring 225 is captured within the sub-block 223, to press on bushing 231, exerting lateral force as a result on the screw 227 and the cap, Thus, any paper lying on the pins will be tensioned by action of the spring. The cap of the block is configured to slide lengthwise about ⅛inch. Thus, when a sheet is brought to the splicer, to be engaged with the spaced apart pin arrays of blocks 214 and 216 on one side of the base, the operator pushes the top of block 214 against the spring resistance to make the distance L smaller, sufficient to match the distance between the opposing perforated side rows of the sheet. The sheet end is first engaged with pins of block 216, and it is then lowered onto the pins of block 214. The operator then releases the manual force being applied to the cap, and the spring tension on cap 221 of each block 214 pulls the sheet taut. Typically, the springs provide the cap of a block 214 with an effective spring rate of about 15 pounds per inch. While the rectanguloid blocks shown are preferred, the term "blocks" is intended to encompass generally any structure carrying projecting pins, performing the functions which have been described, namely, to enable the pin arrays to engage and tension the opposing sides of a perforated sheet. It further should be understood that for operator convenience the front pin block is the spring-biased block, whereas in the generality of this aspect of the invention either the front or the rear, or both blocks may be spring biased.

When both sheet ends have been engaged with the pins on opposing sides of the base as just described, so they are tensioned, the top bars 206 are rotated downwardly to essential parallelism with the base 212, so that the foam rubber of resilient strip 208 on the underside of the top presses each paper sheet against the resilient strip 210 on the top surface of base 212. While pivoting is preferred, the top may be mated with the base by other means. Thus, in an alternative embodiment, the top may be cantilevered from one or more uprights at the rear of the base, sliding vertically along them; or the top may be a fully separate piece. While the force of gravity with manual downward operator force is usually sufficient to provide the required frictional force on the sheets, clamps or other load producing devices may be employed.

Once the sheets have been secured within in the clamp assembly so their butt ends mate, the tape dispenser 160 is moved lengthwise along the slot 205 of the top. How the splicer is constructed and guided along the length of the top is indicated by considering FIG. VI in combination with the other figures. The dispenser 160 is carried along the top by carriage assembly 233, comprised of carriage 242 and arm 248, so the dispenser lower end 200 runs within lengthwise vertical slot 205 of the top. The carriage 242 has internal bore holes 240 by means of which it mounts on rods 238. FIG. VI indicates how the carriage will straddle the top bars 206. Arm 248 is pivotally mounted from pivot pin 246 of the carriage 242. The arm 248 has a sideways-projecting handle 220, by which the operator causes the carriage assembly to move along the rails 238. The arm 248 has a pin 232 which is received in pivot hole 237 of the tape dispenser 160. The arm 248 also has a pin 252 which is adapted to engage a cam at the end of the travel path, to thereby cause the arm to pivot upwardly, as will be described.

The hole 237 of the tape dispenser 160 is made to fit a bit loosely on the mounting pin 232 of the arm 248. This enables the dispenser to rock laterally a very small amount, in a plane transverse to the length of the clamp assembly. Thus, when the dispenser is mounted on the arm 248 and the carriage 242 is mounted the rods 238, the lower end 200 of the dispenser 160 is positioned in the slot 205 between the spaced apart top bars 206, in a manner such that the lower end of the dispenser will contact the sheets which are captured by the resilient strips of the clamp assembly, as described above.

To use the dispenser, the operator pulls the handle 220, to move the carriage assembly and thus cause the dispenser to more along a rear-to-front travel path. The fit and engagement of the lower end 200 of the dispenser with slot 205 between the bars of the top is intentionally not precise for the same reason the fit between the dispenser and its mounting pin 232 is not precise, as mentioned above. However, the fit is sufficient to prevent the lower end from moving laterally (side to side relative to the length of the top) to any significant degree, because the lateral motion would undercut the desired positioning of a perforated tape so its perforations are aligned with the butt joint.

Contact of the bottom tip 226 of the lower end 200 of the dispenser on the sheet/tape surface controls the precise vertical location of the dispenser and the angular orientation in the vertical plane of travel. Thus, the dispenser is adapted to rock slightly in a plane transverse to the dispenser travel path, so it may accommodate any lengthwise and transverse unevenness along the joint being spliced. The accommodation helps ensure that the tape adheres to the sheets on both sides of the joint. FIG. XI is a end cross section view like FIG. VIII, showing a preferred top configuration particularly adapted to enabling the slight transverse rocking motion of the dispenser. Bars 206A have a right angle cross section, and the inner edges provide relatively little depth to slot 205. The inner edges of the slot are also made with a radius, so the lateral motion is controlled by the bottommost edges of the slot opening.

The operator's movement of the dispenser causes the dispenser to lay down tape, as will be next described. Because of the foam rubber cushions 208 on the underside of top bars 206 are placed in close proximity to the joint—with barely more space therebetween than is needed to lay down the tape, there is minimal tendency for the sheets to deform and for a "bubble" of paper to be created just ahead of the tape being laid, as the dispenser moves across the joint.

Referring to FIGS. IV, VIII, IX and X, a reel of tape 222 is mounted on a large diameter pin 227 at the upper end of the dispenser. Tape is drawn from the reel and passed vertically downward to the underside of the lower end 200 of the dispenser. FIG. IX shows in cross section how the front part of the lower end of the dispenser has a groove to guide the tape. Leaf spring retainer 224 at the front end of the dispenser also helps guide the tape by holding the tape against the body and within the groove. Various types of tape may be used. Tapes which may be used for paper sheets are No. 914 blue reputable adhesive tape and No. S338 clear matte acrylic adhesive tape,(Minnesota Mining & Manufacturing Co., Minneapolis).

To apply tape and form the splice joint, the dispenser is first contacted with the abutting joint sheets within the closed clamp assembly, at the rear end of the slot. The dispenser is moved lengthwise, as shown by the horizontal arrow in FIG. VIII, to thereby deposit the tape 222 on the surface of the abutting sheets, where they lie on strip 210. Adhesive engagement of the tape with the sheet draws tape from the reel as the dispenser is moved along slot 205. A wiper 254 is attached to the arm 248 of the carriage. The wiper is made of thin flexible steel, like that of a leaf spring, and has a plastic cap at the lower where it contacts the tape. The wiper 254 presses on the tape as it is being laid. It has the primary function of ensuring that the first portion of the tape laid down, that nearest the rear end of the clamp assembly, is pressed fully against the paper.

When the dispenser is moved to near the end of its travel path within the slot 205 it serially engages cams 236, 235 which are mounted at the end of the front end of the top. The cams are schematically illustrated in FIG. VI. From the text (and associated drawings) which follows, it will be appreciated that an artisan can choose different structures for the cam, so long as the working surfaces of the cams are positioned to interact with the pins on the carriage assembly and dispenser in the way described. Of course, other mechanisms may also be subsituted for the pins and cams to achieve the particular dispenser movements.

Referring to FIG. X, pin 234 of the dispenser engages first cam 236 and that causes the whole dispenser, and thus most particularly the dispenser lower end 200, to rotate about pin 232. The rotation causes the tip 226 to lift from the paper, and with it the tape proximate the tip since, as illustrated, the trailing edge comer 230 tends to contact the tape surface where it lies on the sheet. The rotation causes knife 228 to be brought toward contact with the tape.

Precisely correlated with the dispenser movement just described is the contact of pin 252 of the arm 248 with a second cam 235, not shown in FIG. X. The contact causes the arm to pivot upwardly about pivot 246, thus lifting upwardly a small distance the pin 232 and the dispenser mounted thereon. The resultant crooked path which pin 232 (and thus the dispenser) follows near the end of the dispenser travel path is nominally indicated by dashed line 256 in FIG. X. The dispenser does not continue on the upwardly angled path but for a short distance (less than the dashed line suggests for graphic purpose), sufficient to lift the lower end of the dispenser upwardly slightly from the surface of the paper sheets. As the motion continues with the dispenser rotating and moving upwardly at an angle, the trailing edge 230 of the lower end of the dispenser rubs on the tape which is on the sheet. The rotation and lifting motion of the dispenser also cause the knife 228 to cut the tape, while avoiding any cutting of the knife into the rubber 210. With continued motion, the dispenser trailing edge 230 presses the cut-end of the tape onto the paper, to complete the splicing. Then the top 207 of the splicer is pivoted upwardly, carrying with it the dispenser and carriage assembly. The carriage assembly and dispenser are then returned to the starting point at the rear of the top.

It will be appreciated from the Figures, that to accomplish the above described result, the tip 226 is the lowermost part of the dispenser when it is moving along the dispenser travel path, except when the cams are engaged. The rounded trailing edge 230 at the rear part of the lower end has an elevation higher than the tip except when the cams are engaged. Likewise, the cutting edge of the knife is intermediate in elevation between the rear and front parts.

While the foregoing motions are lengthy in explanation, the operation of the dispenser is quick and easy, with minimal skill required by an operator to get reliable and reproducible results. When the sheets being joined do not have perforated holes for sprockets, the operation is the same except for those which are peculiar to engaging the holes. Various mechanical guides may optionally be attached to the base, to guide the edges of the sheets and thus assure a well aligned joint. While a particular dispenser riding on a carriage, as has been described, is much preferred, other dispensers may be used within the generality of the invention which involves the clamp assembly and associated structures.

Referring again to FIG. II and III, the splicer clamp assembly 204 is typically mounted on top of, and cantilevered from, a column 190 which extends upwardly from a machine base, or a wheeled dolly 177 as shown in FIG. XIII, or other support.

When the column is fixed to the base of a machine such as a belt conveyor, FIG. III shows how the splicer may be laterally adjusted. A block 191 is fastened to the top of the column 190. The block has two bore holes to slidably receive base rods 193 attached to the underside of the splicer base 212. This enables the splicer to be moved laterally relative to the column to a desired horizontal position.

The column 190 may be fabricated with swivel support structure that provides a desired combination of vertical or rotary motion to the column 190.

It is sometimes desired that a splice be made on the underside of the sheet. This is accomplished by the method illustrated schematically by FIG. XII, which ought be compared to FIG. I. One of the sheet ends being joined, the header, or the footer 152B as shown in the Figure, is run along an S-shape curve, over the cantilever bar 171 which is positioned above the splicer 170, and then into the splicer. The other sheet end, header 150C, is run underneath the splicer, so it follows a U-shape path, and enters from the side opposite from which it would normally be entering. The tape is applied by the dispenser as described, to the underside of the sheets. The splicer clamp is opened and the spliced sheet is slid off the end of the reversing bar 171. FIG. XIII shows how the reversing bar 171 is mounted above a splicer, by being fastened to the splicer base. Alternatively the bar may be fastened otherwise, such as from the column 190 which extends from wheeled dolly 177. The bar 171 is preferably made of light weight tubing and as a folded-U, so there are parallel members running from the splicer to the U-connection at the tip of the bar. Of course, the reversing bar technique can be employed with other types of splicers than that described herein and for other than fanfold stacks.

Although this invention has been shown and described with respect to a preferred embodiment, it will be understood by those skilled in this art that various changes in form and detail thereof may be made without departing from the spirit and scope of the claimed invention.

We claim:

1. A splicer, for joining together the ends of two sheets by means of a tape, which comprises:

(a) a clamp assembly comprised of a base, having a length, a front end, and a rear end; a first layer of resilient material running along the length of the top surface of the base, the layer having a first width; and, a top, comprised of two spaced apart bars defining a lengthwise slot therebetween, the slot having a width less than said first width; two second layers of resilient material, one each running along the length of the bottom; the top movably positionable with respect to the base for engagement and disengagement;

wherein, when the top is moved to engagement with the base, so the bottom surface of the top and the top surface of the base are in proximity, the slot is centered over the base, so said first layer is aligned with and opposingly mated with the pair of second layers, wherein when the ends of two sheets are butted together and laid on the surface of the base, the ends of the two sheets will be frictionally captured between the mating first and second layers, to define a butt line; and, (b) a dispenser, for applying a layer of tape to form a joint between the ends of sheets which are butted together and held within said clamp assembly, the dispenser fitting within said slot and movable along the length thereof; wherein, when the dispenser is moved on a travel path running lengthwise along the length of the slot, the dispenser lays a layer of tape along said butt line between sheets captured between the mated top and base, to thereby form a taped joint between the sheets; wherein, the dispenser presses on the tape as the tape is progressively laid down.

2. The splicer of claim 1, particularly adapted for splicing sheets having perforated side edges, which further comprises:

a first block having an array of pins for engaging perforations in a sheet, mounted on the base near the rear end of thereof;

a second block having an array of pins for engaging perforations of a sheet, mounted on the base near the front end thereof;

wherein one of said blocks is movable a short distance along the length of the base in spring biased fashion toward a rest position which is furthest from the block at the other end of the base; and wherein, when the opposing perforated side edges of a said sheet is engaged with the first and second blocks, the sheet is tensioned.

3. The splicer of claim 2 wherein the opposing one of said blocks is adjustably positionable along the length of the base, to accommodate different widths of perforated sheets.

4. The splicer of claim 2 having means for pivoting the dispenser, in the vertical plane running along the travel path, in vicinity of the front end of the top; wherein, the dispenser further comprises:

means for holding a reel of tape so tape may be drawn from the reel;

a lower end, for pressing on the tape while the tape is laid on the sheets in vicinity of the joint during movement of the dispenser along the length to the top; the lower end having means for cutting the tape, said lower end of the dispenser having a front part and a rear part corresponding with the front end and rear end of the base, and comprising:

means for guiding tape onto the joint at the front part of the lower end;

a rounded trailing edge at the rear part of the lower end, for rubbing along the tape as the tape is deposited on the joint between the sheets when the dispenser reaches the end of its travel path, the rounded trailing edge having a first elevation;

a bottom tip, for rubbing on tape as the tape is being deposited along the length of the joint between the sheets; said bottom tip intermediate the front and rear parts of the lower end and having an elevation lower than the first elevation;

a knife, for cutting tape, attached to said lower end between the front part and rear part; said knife having an elevation intermediate the first elevation and the elevation of the tip;

means for causing pivoting of the dispenser at the end of the travel path;

wherein, as the dispenser moves along the first part of the travel path, the tip contacts the tape being laid, and wherein, as the dispenser approaches the end of the travel path the dispenser simultaneously pivots and rises, to cause the knife to cut the tape and to raise the tip upwardly and cause the trailing edge to press down the tape cut end which lies on the joint.

5. The splicer of claim 4 wherein the means for pivoting the dispenser comprises a dispenser having a pin; and, a first cam mounted proximate the front end of the top, for engaging the pin and thereby causing the dispenser to pivot on the arm; and, wherein, the splicer further comprises a carriage arm having a pin; and, a second cam mounted on the top, to engage the carriage pin, to thereby cause the arm and the dispenser mounted thereon to rise.

6. The splicer of claim 4 further comprising a wiper, attached to the carriage rearward of the dispenser, for rub along tape laid on the joint at the beginning of the travel path.

7. The splicer of claim 1 further comprising: means for guiding a carriage along length of the top, from vicinity of the rear end of the base to vicinity of the front end of the base, attached to the top; and, a carriage engaged with said means for guiding, movable along the length of the top; wherein, the dispenser is mounted on said carriage.

8. The splicer of claim 7 wherein the carriage has a pin for carrying the dispenser; the dispenser mounted on said pin, for pivotable motion relative to the carriage within the lengthwise vertical plane of the top; wherein the fit of the mounting of the dispenser on the carriage pin and the fit of the dispenser within the slot sufficiently are both sufficiently loose to enable the dispenser to rock slightly in a plane transverse to the length of the top, as the dispenser moves on said travel path while pressing on the tape being adhered to the sheets.

9. The splicer of claim 1 further comprising: means for pivotably attaching the top to the base at the rear end of the base; wherein the top is movably positionable onto the base by pivoting downwardly.

10. The splicer of claim 1 further comprising: a reversing bar spaced apart from and above the clamp, so that the end of a sheet running toward one side of the clamp for being joined may be caused to follow a S-shape curve path by running around said bar.

11. A method of splicing together the ends of two sheets by joining the ends of the sheets together in a splicer while the sheet ends are held in close proximity to each other, wherein the splicer comprises (a) clamp assembly for receiving and holding sheets running from two respective sources of sheet, and a dispenser; the clamp assembly having a base, having a length, a front end, and a rear end; a first layer of resilient material running along the length of the top surface of the base, the layer having a first width; and, a top, comprised of two spaced apart bars defining a lengthwise slot therebetween, the slot having a width less than said first width; two second layers of resilient material, one each running along the length of the bottom; the top movably positionable with respect to the base for engagement and disengagement;

wherein, when the top is moved to engagement with the base, so the bottom surface of the top and the top surface of the base are in proximity, the slot is centered over the base, so said first layer is aligned with and opposingly mated with the pair of second layers, wherein when the ends of two sheets are butted together and laid on the surface of the base, the ends of the two sheets will be frictionally captured between the mating first and second layers, to define a butt line; and, (b) a dispenser, for applying a layer of tape to form a joint between the ends of sheets which are butted together and held within said clamp assembly, the dispenser fitting within said slot and movable along the length thereof; wherein, when the dispenser is moved on a travel path running lengthwise along the length of the slot, the dispenser lays a layer of tape along said butt line between sheets captured between the mated top and base, to thereby form a taped joint between the sheets; wherein, the dispenser presses on the tape as the tape is progressively laid down;

which method comprises: running the two sheets along different shape paths to the splicer; wherein one sheet runs along a U-shape path from a spaced apart first location; and, wherein the other sheet runs along an S-shape path from a spaced apart second location.

* * * * *